US011114746B2

(12) United States Patent
Wang et al.

(10) Patent No.: US 11,114,746 B2
(45) Date of Patent: Sep. 7, 2021

(54) TERMINAL

(71) Applicant: Huawei Technologies Co., Ltd., Shenzhen (CN)

(72) Inventors: Hanyang Wang, Reading (GB); Chih-Wei Hsu, Taipai (TW); Chih-Hua Chang, Taipai (TW); Chien-Ming Lee, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 168 days.

(21) Appl. No.: 16/337,863

(22) PCT Filed: Sep. 29, 2016

(86) PCT No.: PCT/CN2016/100954

§ 371 (c)(1),
(2) Date: Mar. 28, 2019

(87) PCT Pub. No.: WO2018/058477

PCT Pub. Date: Apr. 5, 2018

(65) Prior Publication Data

US 2019/0356041 A1 Nov. 21, 2019

(51) Int. Cl.

| | |
|---|---|
| ***H01Q 1/24*** | (2006.01) |
| ***H01Q 13/10*** | (2006.01) |
| ***H01Q 5/335*** | (2015.01) |

(52) U.S. Cl.

CPC ..... *H01Q 1/243* (2013.01); *H01Q 5/335* (2015.01); *H01Q 13/10* (2013.01)

(58) Field of Classification Search

CPC ..... H01Q 1/243; H01Q 5/335; H01Q 13/10; H01Q 9/42; H01Q 7/00; H01Q 21/28; H01Q 1/44; H01Q 1/38

See application file for complete search history.

(56) References Cited

U.S. PATENT DOCUMENTS

| | | | |
|---|---|---|---|
| 8,384,608 | B2 | 2/2013 | Dejean |
| 8,854,265 | B1 | 10/2014 | Yang et al. |

(Continued)

FOREIGN PATENT DOCUMENTS

| | | | |
|---|---|---|---|
| CN | 1787284 | A | 6/2006 |
| CN | 203300789 | U | 11/2013 |

(Continued)

OTHER PUBLICATIONS

Wong, K., "8-antenna and 16-antenna arrays using the quad-antenna linear array as a building block for the 3.5-GHz LTE MIMO operation in the smartphone," Microwave and Optical Technology Letters, vol. 58, No. 1, 8 pages.

(Continued)

*Primary Examiner* — Dimary S Lopez Cruz
*Assistant Examiner* — Michael M Bouizza
(74) *Attorney, Agent, or Firm* — Conley Rose, P.C.

(57) ABSTRACT

A terminal includes a conductive substrate and a printed circuit board that are disposed opposite to each other, a first slot is disposed in a direction from a first side edge of the conductive substrate to a center of the conductive substrate, and a projection of the printed circuit board on the conductive substrate is located inside the conductive substrate, and a first feeder is disposed inside the first slot, a first connection end of the first feeder is coupled to a lap joint of the first side edge, a second connection end of the first feeder is coupled to a first feeding source on the printed circuit board, and projections of the lap joint of the first side edge and the first feeding source on the conductive substrate are located on two sides of the first slot.

20 Claims, 10 Drawing Sheets

(56) References Cited

U.S. PATENT DOCUMENTS

| | | | | |
|---|---|---|---|---|
| 2004/0008146 | A1 | 1/2004 | Ikegaya et al. | |
| 2009/0073047 | A1 | 3/2009 | Le Bolzer et al. | |
| 2012/0176278 | A1 | 7/2012 | Merz et al. | |
| 2013/0181871 | A1 | 7/2013 | Eom et al. | |
| 2013/0271333 | A1 | 10/2013 | Taura | |
| 2013/0328730 | A1 | 12/2013 | Guterman et al. | |
| 2014/0062815 | A1 | 3/2014 | Tsai et al. | |
| 2014/0078008 | A1 | 3/2014 | Kang et al. | |
| 2014/0285386 | A1 | 9/2014 | Merz et al. | |
| 2015/0070219 | A1* | 3/2015 | Dinh | H01Q 1/44 343/702 |
| 2016/0088130 | A1 | 3/2016 | Jung et al. | |
| 2018/0323497 | A1 | 11/2018 | Kang et al. | |

FOREIGN PATENT DOCUMENTS

| | | | |
|---|---|---|---|
| CN | 204596970 | U | 8/2015 |
| CN | 204651491 | U | 9/2015 |
| CN | 105322280 | A | 2/2016 |
| CN | 105337036 | A | 2/2016 |
| CN | 105552520 | A | 5/2016 |
| EP | 3073566 | B1 | 12/2017 |
| JP | 2004048119 | A | 2/2004 |
| JP | 2009501468 | A | 1/2009 |
| KR | 20130084931 | A | 7/2013 |
| KR | 20130118919 | A | 10/2013 |
| KR | 20140037687 | A | 3/2014 |
| WO | 2012107976 | A1 | 8/2012 |
| WO | 2014197692 | A1 | 12/2014 |

OTHER PUBLICATIONS

Foreign Communication From a Counterpart Application, European Application No. 16917231.9, Extended European Search Report dated Jul. 30, 2019, 11 pages.

Machine Translation and Abstract of Korean Publication No. KR20130084931, Jul. 26, 2013, 17 pages.

Foreign Communication From a Counterpart Application, Korean Application No. 10-2019-7011178, Korean Office Action dated Nov. 28, 2019, 5 pages.

Foreign Communication From a Counterpart Application, Korean Application No. 10-2019-7011178, English Translation of Korean Office Action dated Nov. 28, 2019, 2 pages.

Machine Translation and Abstract of Chinese Publication No. CN1787284, Jun. 14, 2006, 9 pages.

Machine Translation and Abstract of Chinese Publication No. CN105322280, Feb. 10, 2016, 9 pages.

Machine Translation and Abstract of Chinese Publication No. CN105337036, Feb. 17, 2016, 14 pages.

Machine Translation and Abstract of Chinese Publication No. CN105552520, May 4, 2016, 18 pages.

Machine Translation and Abstract of Chinese Publication No. CN203300789, Nov. 20, 2013, 8 pages.

Machine Translation and Abstract of Chinese Publication No. CN204596970, Aug. 26, 2015, 28 pages.

Machine Translation and Abstract of Chinese Publication No. CN204651491, Sep. 16, 2015, 15 pages.

Jin, Z., et al., "Compact Wideband Open-End Slot Antenna With Inherent Matching," IEEE Antennas and Wireless Propagation Letters, vol. 13, 2014, pp. 1385-1388.

Foreign Communication From a Counterpart Application, Chinese Application No. 201680042430.7, Chinese Office Action dated Apr. 23, 2019, 9 pages.

Foreign Communication From a Counterpart Application, PCT Application No. PCT/CN2016/100954, English Translation of International Search Report dated Jun. 26, 2017, 2 pages.

Foreign Communication From a Counterpart Application, PCT Application No. PCT/CN2016/100954, English Translation of Written Opinion dated Jun. 26, 2017, 3 pages.

* cited by examiner

TERMINAL

CROSS-REFERENCE TO RELATED APPLICATIONS

This application is a U.S. National Stage of International Patent Application No. PCT/CN2016/100954 filed on Sep. 29, 2016, which is hereby incorporated by reference in its entirety.

TECHNICAL FIELD

The present invention relates to the field of communications, and in particular, to a terminal.

BACKGROUND

A slot antenna is an antenna that is formed by cutting out a slot on a surface of a conductor, and is also referred to as a slot antenna. The slot may perform feeding by using a feeder across the surface of the conductor. In this case, a radio frequency electromagnetic field is excited inside the slot, and radiates electromagnetic waves into space.

Referring to FIG. 1, theoretically, to ensure radiation efficiency of an antenna, a feeding source 12 needs to be disposed nearby an opening end (that is, a side edge of a terminal) of a slot, the feeding source 12 is connected to a feeder 13 disposed inside the slot, so as to excite a radio frequency electromagnetic field inside the slot, to achieve a side feed slot antenna.

However, in practice, when the foregoing slot antenna is disposed inside a terminal, the feeding source 12 needs to be disposed on a printed circuit board (Printed Circuit Board, PCB) 14, and be connected to a radio frequency circuit, so as to receive a radio frequency signal generated by the radio frequency circuit. In this way, the feeding source 12 can transmit the radio frequency signal to the feeder 13, to excite a radio frequency electromagnetic field inside the slot.

However, in an actual terminal, as shown in FIG. 1, a PCB area for disposing the PCB 14 is limited by a hook structure on a casing into a central area on a surface of a conductor (that is, a central area of a housing of the terminal) and cannot extend to two side edges of the terminal, so that the feeding source 12 of the foregoing side feed slot antenna cannot be disposed on the opening end of the slot. To be specific, the foregoing side feed slot antenna cannot really be used in an actual terminal.

SUMMARY

Embodiments of the present invention provide a terminal, so as to overcome a limitation of a side feed slot antenna on a position of a feeding source, so that the side feed slot antenna can really be used in the terminal.

The following technical solutions are used in the embodiments of the present invention to achieve the foregoing objective.

According to a first aspect, an embodiment of the present invention provides a terminal. The terminal includes a conductive substrate and a printed circuit board that are disposed opposite to each other, and a first slot is disposed in a direction from a first side edge of the conductive substrate to a center of the conductive substrate, where a first feeder is disposed inside the first slot, a first connection end of the first feeder is connected to a lap joint of the first side edge, a second connection end of the first feeder is connected to a first feeding source on the printed circuit board, and projections of the lap joint of the first side edge and the first feeding source on the conductive substrate are located on two sides of the first slot. In this way, compared with a design solution of a conventional slot antenna, in the terminal provided by the embodiments of the present invention, the first feeding source may be disposed in an area close to the center of the conductive substrate, and the area can usually be covered by the printed circuit board. Therefore, the first feeding source on the printed circuit board can successfully transmit a radio frequency signal to the first feeder, thereby breaking a limitation that in a conventional side feed slot antenna, a feeding source needs to be disposed on a side edge of a conductive substrate, so that the side feed slot antenna can really be used in the terminal.

In a possible implementation, the first feeding source is located on a side close to a display area of the terminal, and the lap joint is located on a side distant from the display area of the terminal.

In a possible implementation, a matching network is disposed on the printed circuit board, where the second connection end of the first feeder is connected to the first feeding source through the matching network. The matching network may adjust a power transmission relationship between a radio frequency signal output by the first feeding source and a radio frequency signal received by the first feeder, and when impedance matching is achieved between the first feeding source and the first feeder, maximum power transmission can be obtained.

In a possible implementation, the matching network includes a resonant circuit, and when a resonant parameter in the resonant circuit is a first parameter, an antenna operating band of the terminal is a first operating band; and when the resonant parameter in the resonant circuit is a second parameter, the antenna operating band of the terminal is a second operating band, the first parameter is different from the second parameter, and the first operating band is different from the second operating band. To be specific, when the resonant parameter in the resonant circuit is set to different values, the antenna operating band of the terminal changes. Therefore, an operating band of a novel antenna structure can be changed by adjusting a value of a resonant parameter in a matching network, so that the terminal can perform wireless communication in different antenna operating bands.

In a possible implementation, a second slot is disposed in a direction from a second side edge of the conductive substrate to the center of the conductive substrate; and a second feeder is disposed inside the second slot, a third connection end of the second feeder is connected to a lap joint of the second side edge, a fourth connection end of the second feeder is connected to a second feeding source on the printed circuit board, and projections of the lap joint of the second side edge and the second feeding source on the conductive substrate are located on two sides of the second slot. To be specific, the foregoing novel antenna structure may be disposed on both the first side edge and the second side edge of the terminal. In this way, the novel antenna structures on two sides of the terminal can both support operating in different antenna operating bands. In this case, when a user holds the terminal from either side, resulting in electromagnetic shielding, the terminal may choose to perform wireless communication by using the novel antenna structure on the other side.

In a possible implementation, a third slot that tends to be parallel to the first slot is further disposed on the conductive substrate, and a slotted position of the third slot is located on the side, distant from the display area of the terminal, of the first slot; and a third feeding source corresponding to the third slot is further disposed on the printed circuit board. The third feeding source may feed a radio frequency signal having a relatively low frequency into the third slot, so that the third slot is excited to implement a function of a low-frequency antenna.

In a possible implementation, a fourth slot is further disposed in the direction from the first side edge to the center of the conductive substrate, and a fourth feeding source corresponding to the fourth slot is further disposed on the printed circuit board; and a fifth slot is further disposed in the direction from the second side edge to the center of the conductive substrate, and a fifth feeding source corresponding to the fifth slot is further disposed on the printed circuit board, where the fourth slot and the fifth slot are located on the side, distant from the display area of the terminal, of the first slot.

In a possible implementation, the conductive substrate is in a curved-surface shape.

In a possible implementation, the conductive substrate is a metal housing of the terminal.

It should be noted that the conductive substrate in the foregoing aspects may be specifically any substrate having a conductive characteristic such as a metal substrate or an ITO (Indium tin oxide, Indium Tin Oxide) substrate. No limitation is imposed in the embodiments of the present invention. The conductive substrate may be used as a radiation component in the antenna, to radiate electromagnetic waves into space under the action of an electromagnetic field.

BRIEF DESCRIPTION OF DRAWINGS

To describe the technical solutions in the embodiments of the present invention or in the prior art more clearly, the following briefly describes the accompanying drawings required for describing the embodiments or the prior art.

DESCRIPTION OF EMBODIMENTS

The following clearly and completely describes the technical solutions in the embodiments of the present invention with reference to the accompanying drawings in the embodiments of the present invention. Apparently, the described embodiments are merely some but not all of the embodiments of the present invention.

In addition, the terms "first" and "second" are merely intended for a purpose of description, and shall not be understood as an indication or implication of relative importance or implicit indication of a quantity of indicated technical features. Therefore, a feature restricted by "first" or "second" may explicitly indicate or implicitly include one or more such features. In the descriptions in the present invention, unless otherwise provided, "a plurality of" means two or more than two.

The term "and/or" in this specification describes only an association relationship for describing associated objects and represents that three relationships may exist. For example, A and/or B may represent the following three cases: Only A exists, both A and B exist, and only B exists. In addition, the character "/" in this specification generally indicates an "or" relationship between the associated objects.

Figure 2:
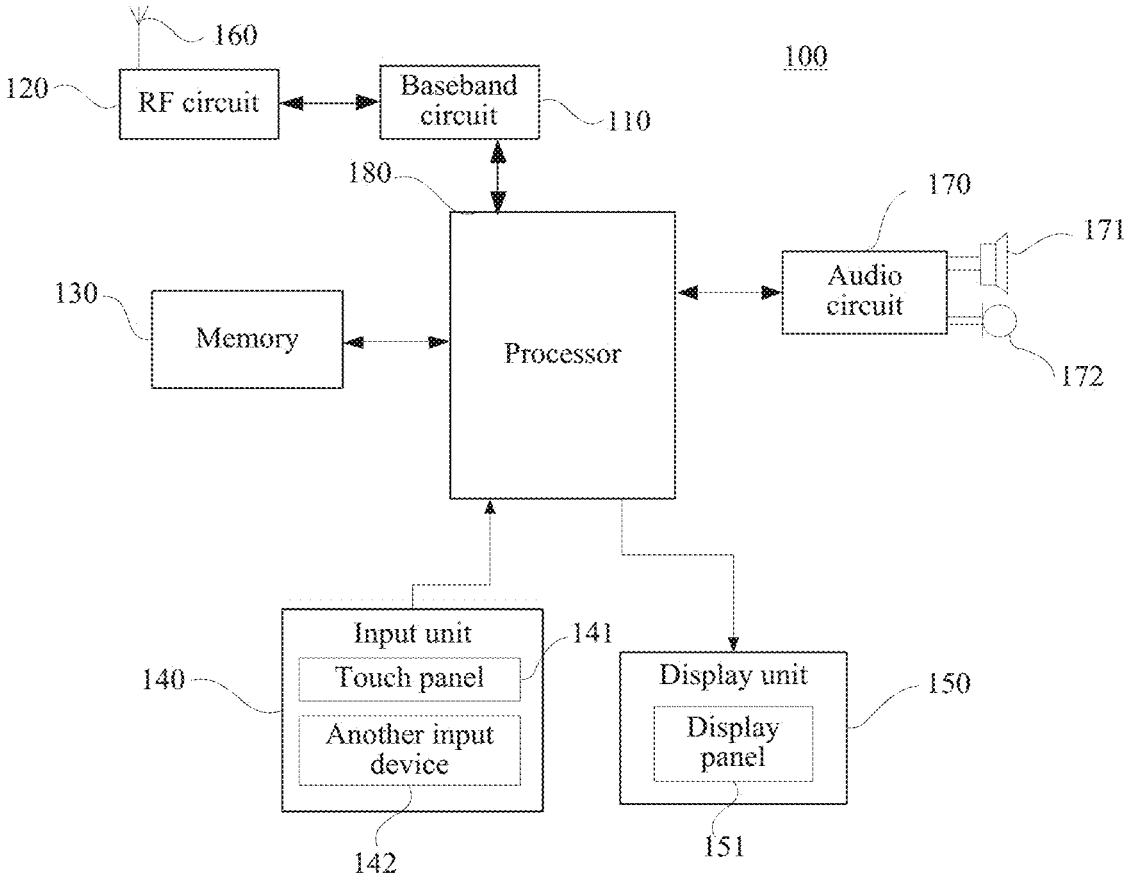
FIG. 2 is a schematic structural diagram 1 of a terminal according to an embodiment of the present invention.

FIG. 2 is a schematic structural diagram of a terminal according to an embodiment of the present invention. The terminal may be a mobile phone, a tablet computer, a notebook computer, a portable/wearable device, a UMPC (Ultra-mobile Personal Computer, ultra-mobile personal computer), a netbook, a PDA (Personal Digital Assistant, personal digital assistant), or the like. In the embodiments of the present invention, an example in which the terminal is a mobile phone is used for description. FIG. 2 is a block diagram of a partial structure of a mobile phone 100 related to the embodiments of the present invention.

As shown in FIG. 2, the mobile phone 100 includes components such as an antenna 160, a baseband circuit 110, an RF (radio frequency, radio frequency) circuit 120, a memory 130, an input unit 140, a display unit 150, an audio circuit 170, a processor 180, and a power supply. A person skilled in the art may understand that the structure of the mobile phone shown in FIG. 2 does not constitute any limitation to the mobile phone, and may include more or less components than those shown in the figure, or some components may be combined, or a different component layout may be used.

The following specifically describes each component of the mobile phone 100 in detail with reference to FIG. 2.

The RF circuit 120 may cooperate with the antenna 160 to receive and send signals in an information receiving and sending process or a call process. Particularly, the RF circuit 120 may receive, through the antenna 160, downlink information delivered by a base station, and send, through the baseband circuit 110, the downlink information to the processor 180 for processing. In addition, the RF circuit 120 may further send, through the antenna 160, uplink data to the base station. Generally, the RF circuit includes, but is not limited to, at least one amplifier, a transceiver, a coupler, an LNA (low noise amplifier, low noise amplifier), a duplexer, and the like. In addition, the RF circuit 120 may further communicate with a network and another device through wireless communication.

The processor 180 is a control center of the mobile phone 100, and is connected to respective parts of the mobile phone by using various interfaces and lines. By running or executing the software program and/or the module stored in the memory 130, and invoking data stored in the memory 130, the processor 180 performs various functions and data processing of the mobile phone 100, thereby performing overall monitoring on the mobile phone. Optionally, the processor 180 may include one or more processing units.

The processor 180 may integrate an application processor and a modem processor. The application processor mainly processes an operating system, a user interface, an application program, and the like. The modem processor mainly processes wireless communication. It can be understood that the foregoing modem processor may alternatively not be integrated into the processor 180. For example, as shown in FIG. 2, the baseband circuit 110 may be disposed independently as the modem processor, configured to modulate, scramble, and encode a source signal generated by the processor 180, and finally, input an encoded digital signal to the RF circuit 320 to convert the digital signal into a radio frequency signal and radiate electromagnetic waves through the antenna 160.

The memory 130 may be configured to store a software program and module. The processor 180 runs the software program and module stored in the memory 130, to implement various functional applications and data processing of the mobile phone 100.

The input unit 140 may be configured to: receive input digit or character information, and generate a key signal input related to a user setting and function control of the mobile phone 100. Specifically, the input unit 140 may include a touch panel 141 and another input device 142.

The display unit 150 may be configured to display information entered by the user or information provided for the user, and various menus of the mobile phone 100. The display unit 150 may include a display panel 151. Optionally, the display panel 141 may be configured by using an LCD (Liquid Crystal Display, liquid crystal display), an OLED (Organic Light-Emitting Diode, organic light-emitting diode), or the like. Although, in FIG. 2, the touchscreen 141 and the display panel 151 are used as two separate parts to implement input and output functions of the mobile phone 100, in some embodiments, the touchscreen 141 and the display panel 151 may be integrated to implement the input and output functions of the mobile phone 100.

The audio circuit 170, a speaker 171, and a microphone 172 may provide an audio interface between a user and the mobile phone 100. The audio circuit 170 may convert received audio data into an electrical signal and transmit the electrical signal to the speaker 171. The speaker 171 converts the electrical signal into a sound signal for output. On the other hand, the microphone 172 converts a collected sound signal into an electrical signal. The audio circuit 170 receives the electrical signal, converts the electrical signal into audio data, and outputs the audio data to the RF circuit 120 to send the audio data to, for example, another mobile phone, or outputs the audio data to the memory 130 for further processing.

The mobile phone 100 may further include other sensors such as a gravity sensor (gravity sensor), an optical sensor, a gyroscope, a barometer, a hygrometer, a thermometer, and an infrared sensor. Details are not described herein.

In actual application, usually, components such as the processor 180, the RF circuit 120, and the baseband circuit 110 are integrated on the printed circuit board. The mobile phone 100 is formed after assembling the printed circuit board with components such as the antenna 160, the display panel, and a backlight source.

Figure 3:
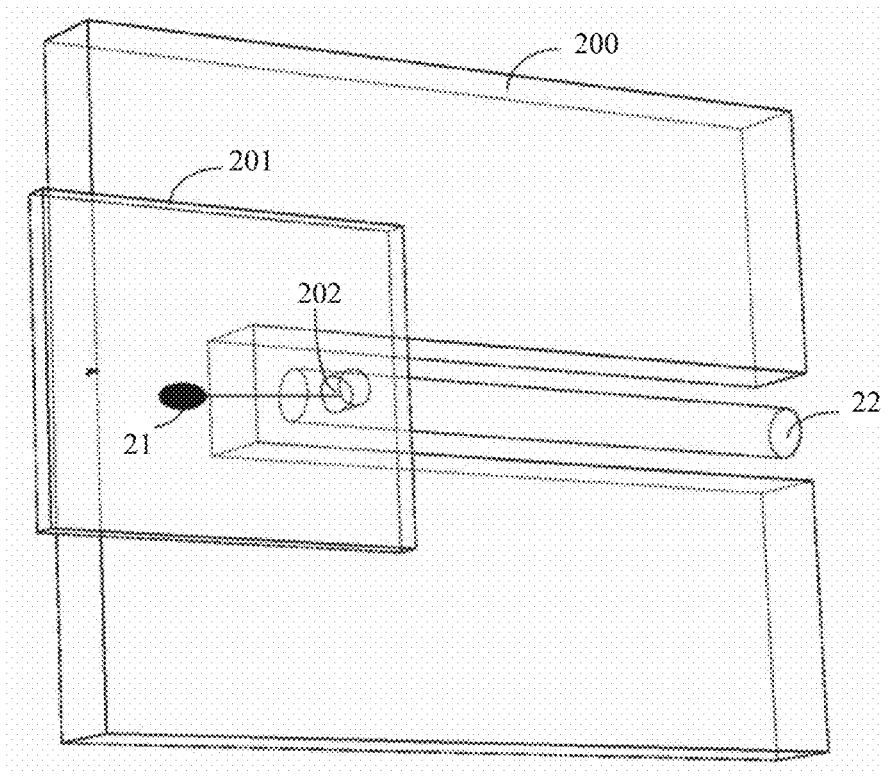
FIG. 3 is a schematic structural diagram 2 of a terminal according to an embodiment of the present invention.

In a possible design manner, the foregoing antenna 160 may be a slot antenna. As shown in FIG. 3, the slot antenna specifically includes: a conductive substrate 200 on which a slot is disposed, a feeder 22 in the slot, and a feeding source 21 that is disposed on the printed circuit board 201 and that is in contact with the feeder 22.

As shown in FIG. 3, the conductive substrate 200 and the printed circuit board 201 are usually disposed opposite to each other. To be specific, usually, a surface parallel to the feeder 22 in the conductive substrate 200 and a surface integrated with circuit components in the printed circuit board 201 are disposed opposite to each other.

Moreover, the feeding source 21 of the printed circuit board 201 may be interpreted as a signal source of the conductive substrate 200 for outputting a radio frequency signal. For example, as shown in FIG. 3, an output end of the radio frequency circuit may be used as the feeding source 21. A radio frequency signal output by the feeding source 21 may be input to the feeder 22 through contact between a protruding dome 202 and the feeder 22 (the feeder 22 is disposed in the slot of the conductive substrate 200) through a protruding dome 202, so as to input the radio frequency signal into the feeder 22. The feeder 22 performs feeding, and finally, excites a radio frequency electromagnetic field in the slot, to enable the foregoing slot antenna to radiate electromagnetic waves in a specific direction.

It should be noted that a first side edge and a second side edge that are mentioned in the following embodiments are a group of opposite edges with which a palm of a user may get in contact when the terminal is used as a handheld device. Usually, the first side edge and the second side edge are a group of opposite edges having relatively long edge lengths.

Figure 4:
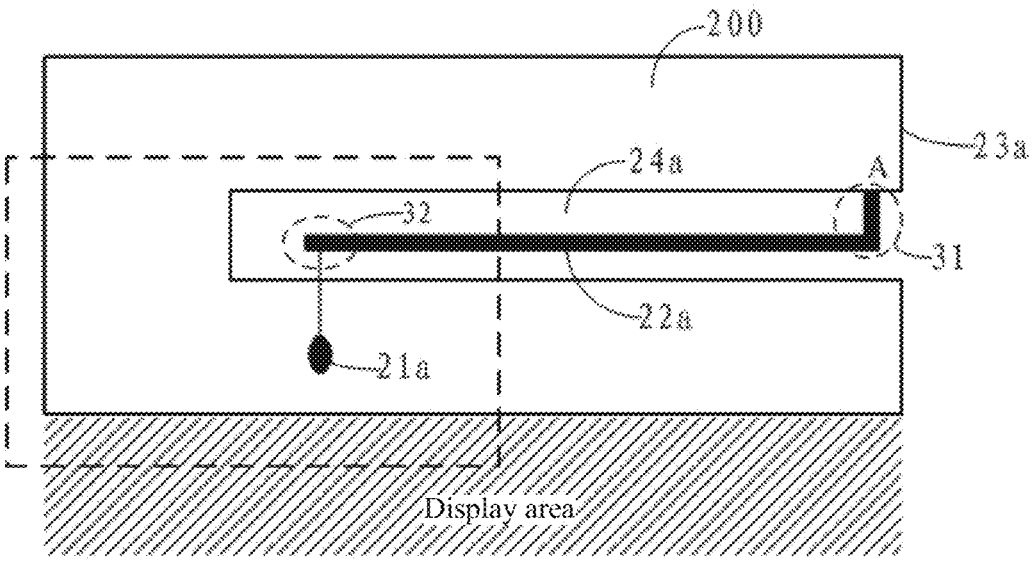
FIG. 4 is a schematic structural diagram 1 of a novel antenna structure according to an embodiment of the present invention.

Specifically, in the embodiments of the present invention, as shown in FIG. 4, in the conductive substrate 200, a first slot **24*a* is disposed in a direction from a first side edge 23*a* of the conductive substrate 200 to a center of the conductive substrate, where a first feeder 22*a* is disposed inside the first slot 24*a*, an end, that is, a first connection end 31, of the first feeder 22*a* is connected to a lap joint A of the first side edge 23*a*, and the other end, that is, a second connection end 32, of the first feeder 22*a* is connected to a first feeding source 21*a* on the printed circuit board 201. The lap joint A may be any point on the first side edge 23*a* or any point close to the first side edge 23*a*. In addition, projections of the lap joint A and the first feeding source 21*a* are located on two sides of the first slot 24*a* on the conductive substrate 200**.

Figure 1:
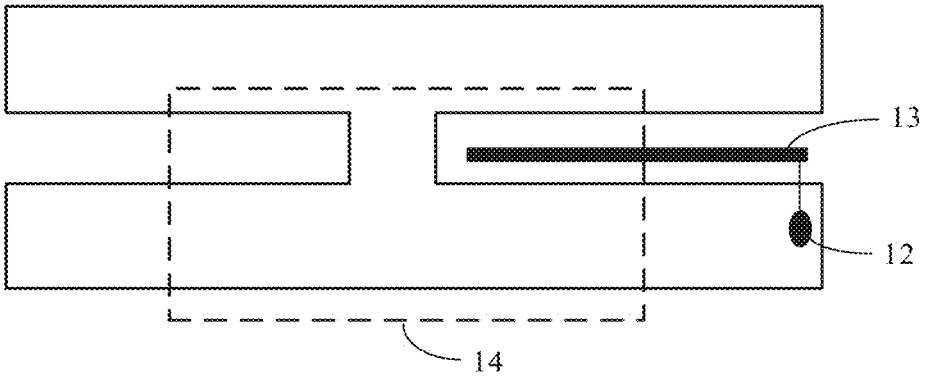
FIG. 1 is a schematic structural diagram of a slot antenna disposed in a terminal in the prior art.

A projection of the printed circuit board 201 on the conductive substrate 200 is located inside the conductive substrate 200. To be specific, the projection of the printed circuit board 201 on the conductive substrate 200 cannot extend to the first side edge **23*a*. Therefore, it can be learned that, compared with a design solution of the slot antenna shown in FIG. 1, in the terminal provided in the embodiments of the present invention, the first feeding source 21*a*** may be disposed in an area close to the center of the conductive substrate, and the area can usually be covered by the printed circuit board 201. Therefore, the first feeding source 21*a* on the printed circuit board 201 can successfully transmit a radio frequency signal to the first feeder 22*a*, thereby breaking a limitation that in a conventional side feed slot antenna, a feeding source needs to be disposed on a side edge of the conductive substrate 200.

In the embodiments of the present invention, the first connection end 31 of the first feeder 22*a* is connected to the lap joint A of the first side edge 23*a*, so as to enable the first feeder 22*a* to be connected to the conductive substrate at the lap joint A. In this way, the radio frequency signal input by the first feeding source 21*a* may be guided through the first feeder 22*a* to the slot of the first side edge 23*a* to excite a radio frequency electromagnetic field, so that a radiation characteristic similar to that of the conventional side feed slot antenna is possessed.

Figure 5:
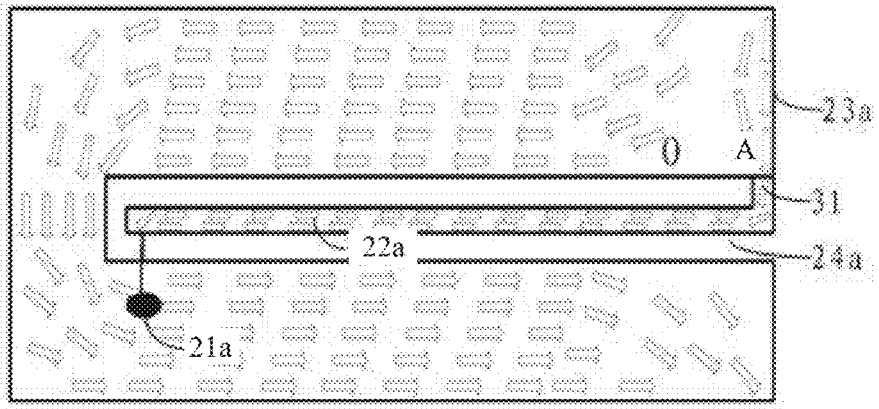
FIG. 5 is a schematic diagram 1 of current distribution of a novel antenna structure according to an embodiment of the present invention.

Specifically, as shown in FIG. 5, when the radio frequency signal input by the first feeding source 21*a* is at 2.35 GHz, because the first connection end 31 of the first feeder 22*a* is connected to the lap joint A of the first side edge 23*a*, a current distribution situation at the lap joint A is changed (that is, a boundary condition at the lap joint A is changed). In this case, compared with a current zero point, that is, the lap joint A, of the conventional side feed slot antenna, although a current zero point O on the conductive substrate 200 slightly deviates toward the center of the conductive substrate, a current on the conductive substrate 200 is still distributed along the first slot 24*a*. This is basically consistent with current distribution of the conventional side feed slot antenna. Therefore, a radiation characteristic similar to that of the conventional side feed slot antenna is possessed by using an antenna design solution provided by the embodiments of the present invention.

Therefore, the antenna design solution in the terminal provided by the embodiments of the present invention can break a limitation that in the conventional side feed slot antenna, the feeding source needs to be disposed on a side edge of the conductive substrate 200, so that the side feed slot antenna can really be used in the terminal.

To distinguish the conventional side feed slot antenna from the side feed slot antenna provided by the embodiments of the present invention, subsequently, the side feed slot antenna provided by the embodiments of the present invention is uniformly referred to as a novel antenna structure.

On the other hand, because the first connection end 31 of the first feeder 22*a* is connected to the lap joint A of the first side edge 23*a*, after passing through the first feeder 22*a*, the radio frequency signal input by the first feeding source 21*a* is transmitted along the first slot 24*a* on the conductive substrate 200, and finally, returns to the first feeding source 21*a*, to form a closed loop. Therefore, a radiation characteristic similar to that of a loop antenna (Loop Antenna) is possessed.

Figure 6:
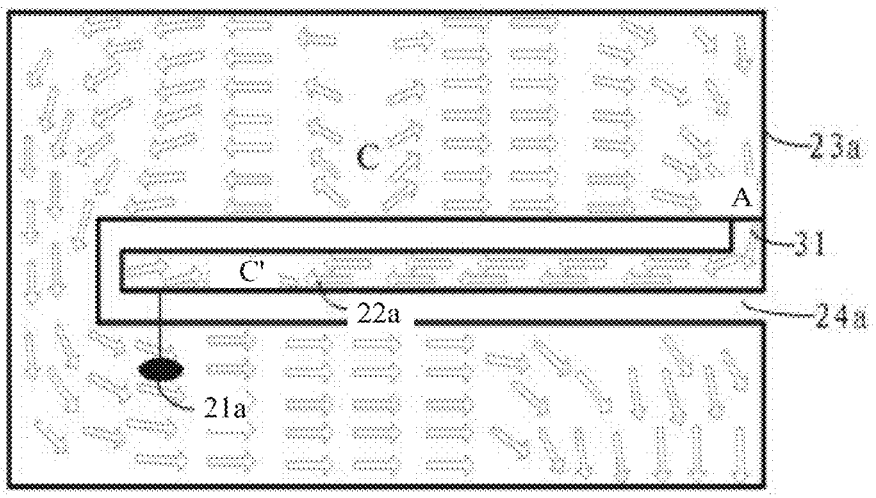
FIG. 6 is a schematic diagram 2 of current distribution of a novel antenna structure according to an embodiment of the present invention.

Specifically, as shown in FIG. 6, when the radio frequency signal input by the first feeding source 21*a* is at 3.6 GHz, because the first connection end 31 of the first feeder 22*a* is connected to the lap joint A of the first side edge 23*a*, and in this case, a current zero point C is generated on the conductive substrate 200, and another current zero point C' is generated on the first feeder 22*a*, a current flows from the point C toward two sides and finally, flows back to the point C' on the first feeder 22*a*. This is the same as current distribution of the loop antenna. To be specific, a radiation characteristic similar to that of the loop antenna (Loop Antenna) may alternatively be possessed by using the antenna design solution provided by the embodiments of the present invention.

Figure 7:
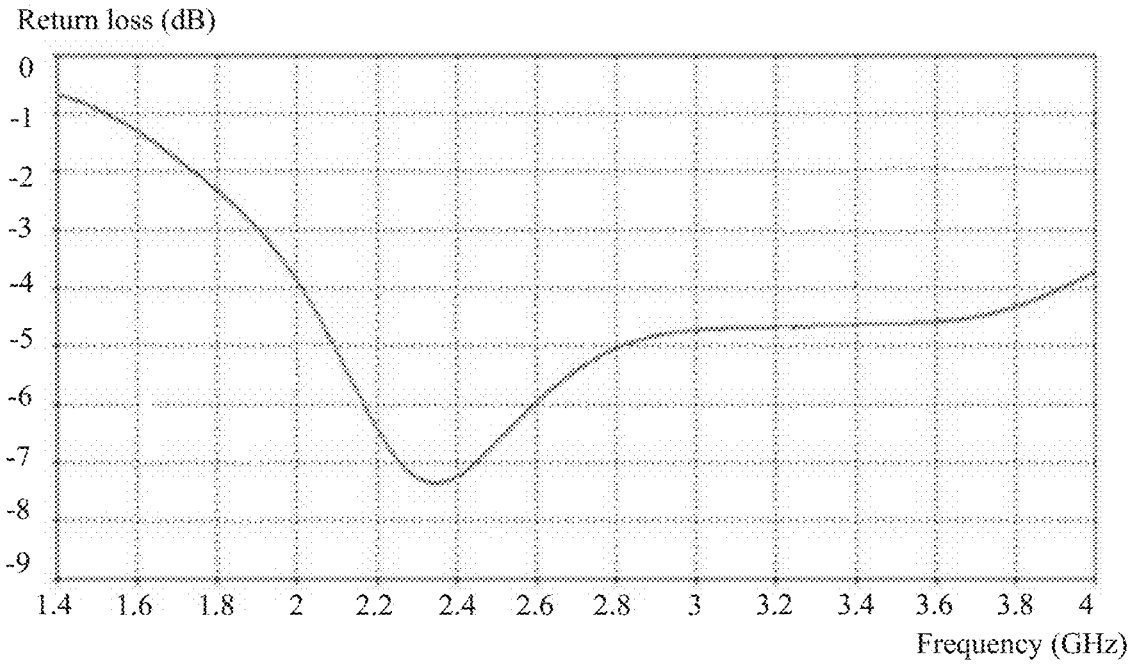
FIG. 7 is a schematic diagram 1 of return loss of a novel antenna structure according to an embodiment of the present invention.
Figure 8:
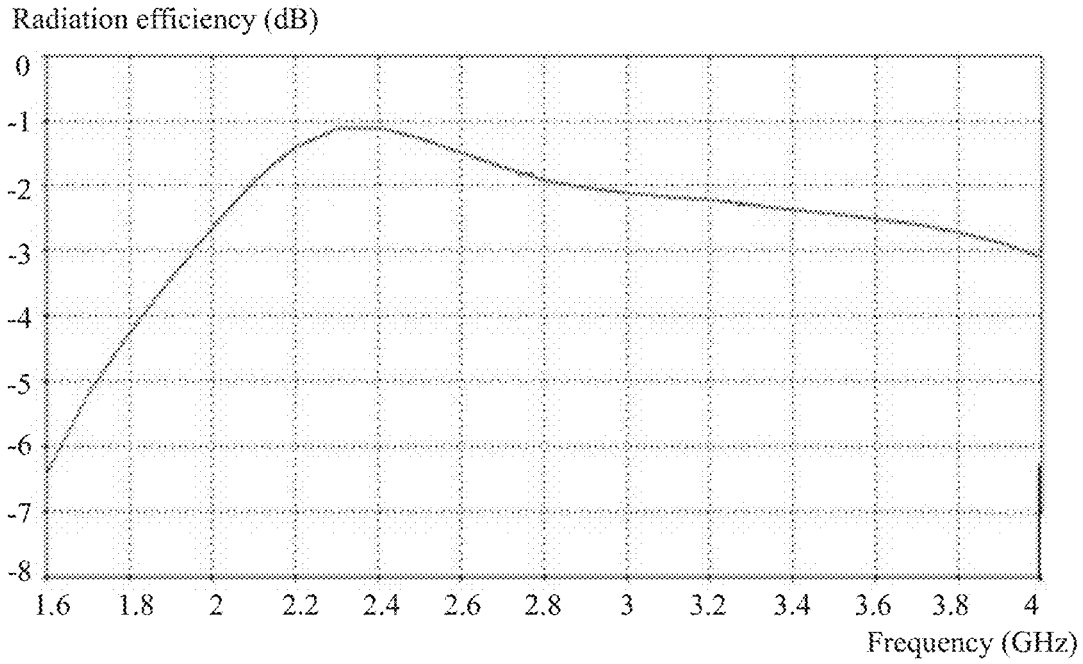
FIG. 8 is a schematic diagram of radiation efficiency of a novel antenna structure according to an embodiment of the present invention.

For example, FIG. 7 shows a simulation result of return loss obtained by using the novel antenna structure shown in FIG. 4. It can be learned that, in a frequency domain range of 2 GHz to 3.9 GHz, the return loss of the novel antenna structure shown in FIG. 4 is always less than −4 dB. To be specific, in a frequency domain range of 1.4 GHz to 4 GHz, a proportion of its impedance bandwidth is approximately (3.9 GHz−2 GHz)/(4 GHz−1.4 GHz)=73%. In addition, FIG. 8 shows a simulation result of radiation efficiency obtained by using the novel antenna structure shown in FIG. 4. It can be learned that, in a frequency domain range of 2 GHz to 3.9 GHz, the radiation efficiency of the novel antenna structure shown in FIG. 4 is always greater than −3 dB. To be specific, the novel antenna structure in the terminal provided by the embodiments of the present invention can obtain a broader operating bandwidth.

In addition, it should be noted that, in the design solution of the foregoing novel antenna structure, it only needs that projections of the lap joint A of the first side edge 23*a* and the first feeding source 21*a* on the conductive substrate 200 are located on two sides of the first slot 24*a*. For example, as shown in FIG. 4, the first feeding source 21*a* is located on a side close to a display area of the terminal, and the lap joint A is located on a side distant from the display area of the terminal. Alternatively, it could be specified as that the first feeding source 21*a* is located on the side distant from the display area of the terminal, and the lap joint A is located on the side close to the display area of the terminal. A person skilled in the art may perform a setting based on actual experience or requirements. No limitation is imposed herein in the embodiments of the present invention.

Figure 9:
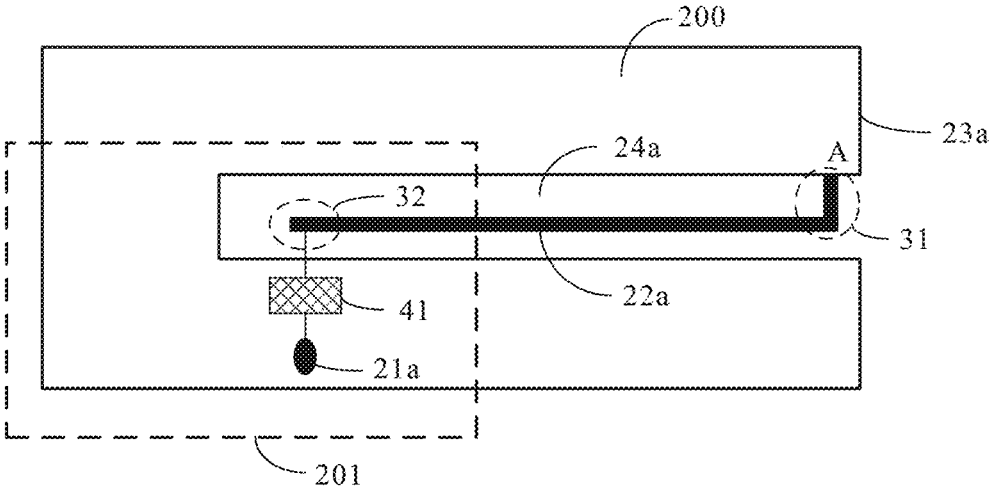
FIG. 9 is a schematic structural diagram 2 of a novel antenna structure according to an embodiment of the present invention.

Further, as shown in FIG. 9, a matching network 41 is further disposed on the printed circuit board 201. In this case, the second connection end 32 of the first feeder 22*a* is connected to the first feeding source 21*a* through the matching network 41.

The matching network 41 may adjust a power transmission relationship between a radio frequency signal output by the first feeding source 21*a* and a radio frequency signal received by the first feeder 22, and when impedance matching is achieved between the first feeding source 21*a* and the first feeder 22*a*, maximum power transmission can be obtained.

For example, the matching network 41 may be in a direct through state. That is, the matching network 41 does not include a device that hinders passing-through of a current such as a capacitor or an inductor.

Figure 10:
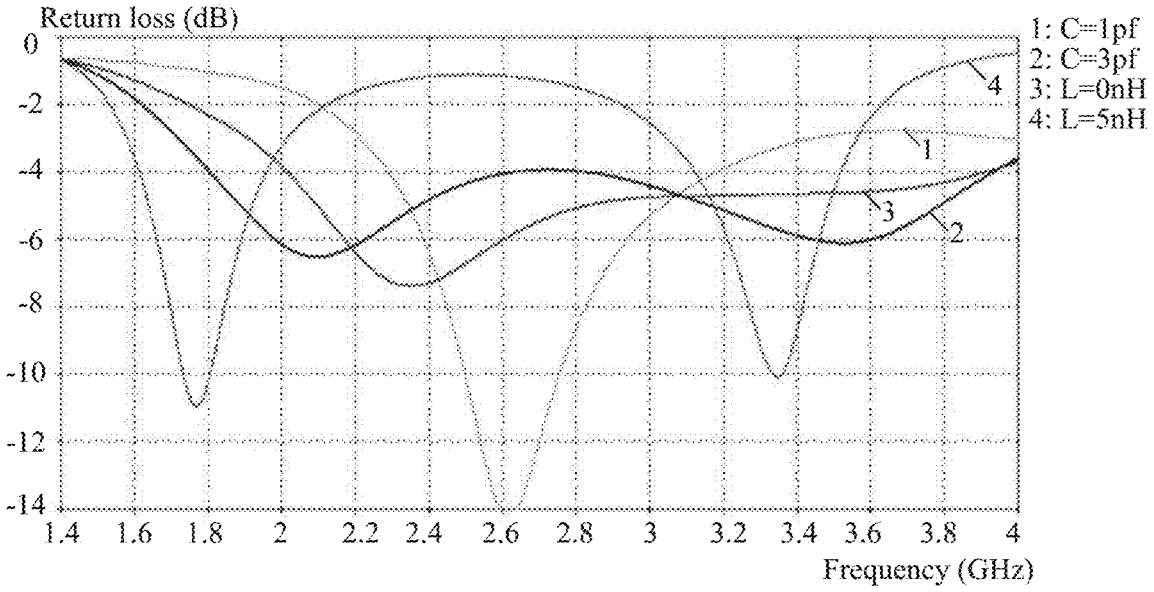
FIG. 10 is a schematic diagram 2 of return loss of a novel antenna structure according to an embodiment of the present invention.

Alternatively, the matching network 41 may include a resonant circuit, and a resonant parameter (for example, a capacitance value and/or an inductance value in the resonant circuit) in the resonant circuit is adjustable, so that when the resonant parameter in the resonant circuit is set to different values, an antenna operating band of the terminal also changes correspondingly. FIG. 10 shows simulation results of return loss obtained by using the novel antenna structure shown in FIG. 9 when different capacitance values C and inductance values L in the matching network are set. It can be learned that, when different capacitance values C and inductance values L are set, a band in which a resonance occurs and a quantity of resonances also change. Therefore, an operating band of the novel antenna structure may be changed by adjusting a value of the resonant parameter in the matching network 41, so that the terminal can perform wireless communication in different antenna operating bands.

Figure 11:
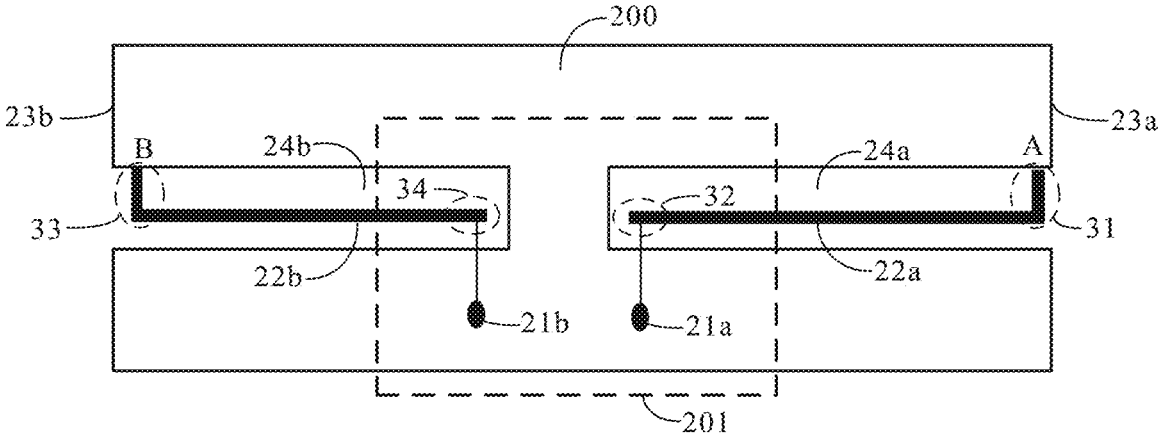
FIG. 11 is a schematic structural diagram 3 of a novel antenna structure according to an embodiment of the present invention.

Further, as shown in FIG. 11, based on the novel antenna structure of FIG. 4 or FIG. 9, the foregoing terminal may further include a second slot 24*b* disposed in a direction from a second side edge 23*b* of the conductive substrate 200 to the center of the conductive substrate. Similar to a relevant structure of the foregoing first slot 24*a*, a second feeder 22*b* is disposed inside the second slot 24*b*, a third connection end 33 of the second feeder 22*b* is connected to a lap joint B of the second side edge 23*b*, a fourth connection end 34 of the second feeder 22*b* is connected to a second feeding source 21*b* on the printed circuit board 201, and projections of the lap joint B of the second side edge 23*b* and the second feeding source 21*b* on the conductive substrate 200 are located on two sides of the second slot 24*b*.

To be specific, the foregoing novel antenna structure may be disposed on both side edges (the first side edge and the second side edge) of the terminal. In this way, the novel antenna structures on two sides, namely, a left side and a right side, of the terminal can both support operating in different antenna operating bands. In this case, when a user holds the terminal from either side, for example, when the user holds the terminal from the right side with the right hand, because a human body is electrically conductive, the novel antenna structure on the right side may be electromagnetically shielded. In this case, the terminal may choose to perform wireless communication by using the novel antenna structure on the left side.

It should be noted that, a position relationship between the lap joint A and the lap joint B and a position relationship between the second feeding source 21*b* and the first feeding source 21*a* are not defined in the embodiments of the present invention. The novel antenna structures corresponding to the first side edge 23*a* and the second side edge 23*b* may be completely the same or different.

Likewise, similar to a relevant structure of the foregoing first slot 24*a*, a matching network corresponding to the second slot 24*b* is further disposed on the printed circuit board 201, and the fourth connection end 34 of the second feeder 22*b* may be connected to the first feeding source 21*b* through the matching network.

Figure 12:
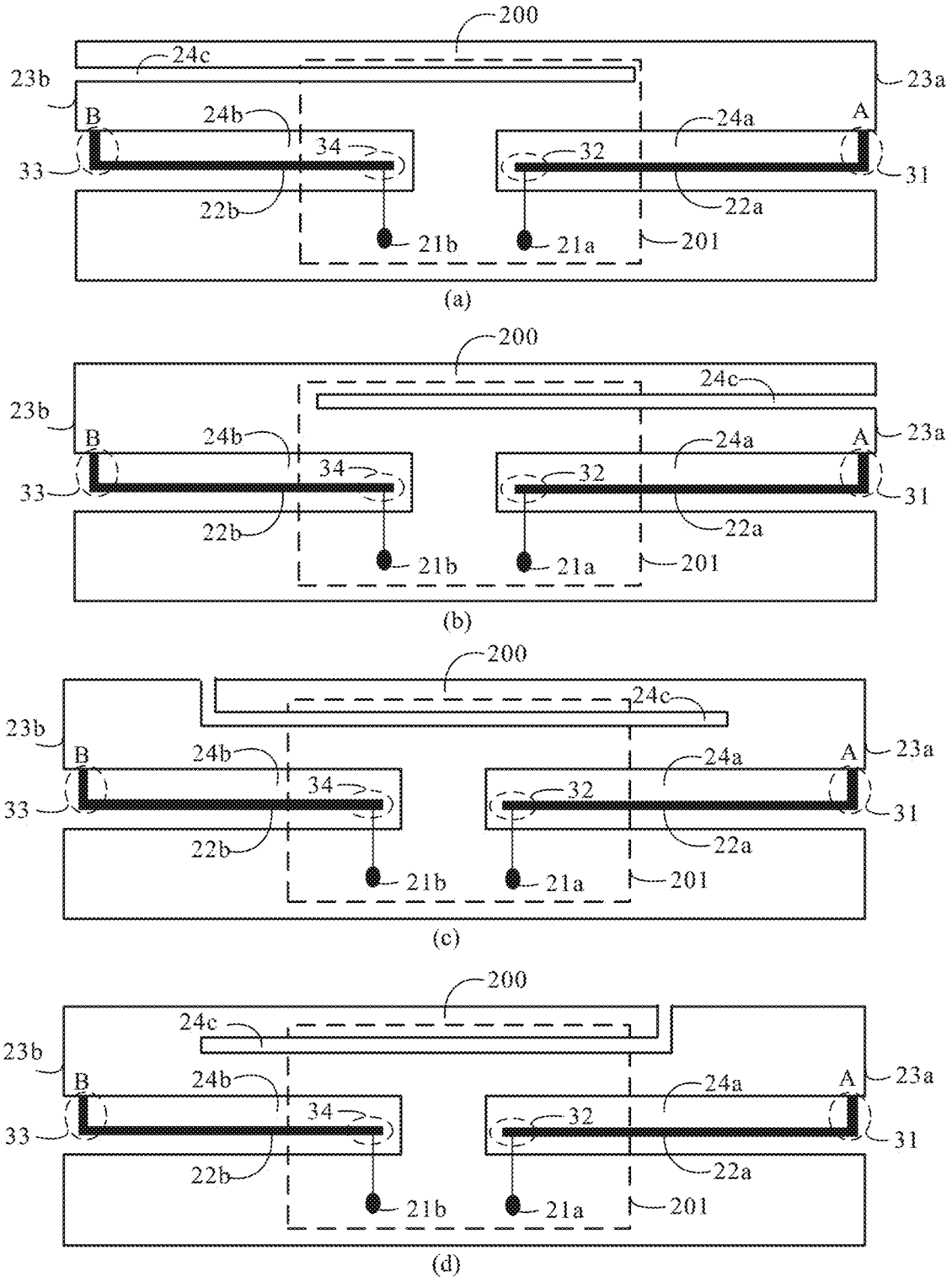
FIG. 12 is a schematic structural diagram 4 of a novel antenna structure according to an embodiment of the present invention.

Further, based on the novel antenna structure shown in FIG. 11, as shown by (a), (b), (c), and (d) in FIG. 12, a third slot 24*c* parallel to the first slot 24*a* is further disposed on the conductive substrate 200, and a slotted position of the third slot 24*c* may be located on any boundary of the side, distant from the display area of the terminal, of the first slot 24*a*. In this case, a third feeding source (not shown) corresponding to the third slot 24*c* is further disposed on the printed circuit board 201.

Figure 13:
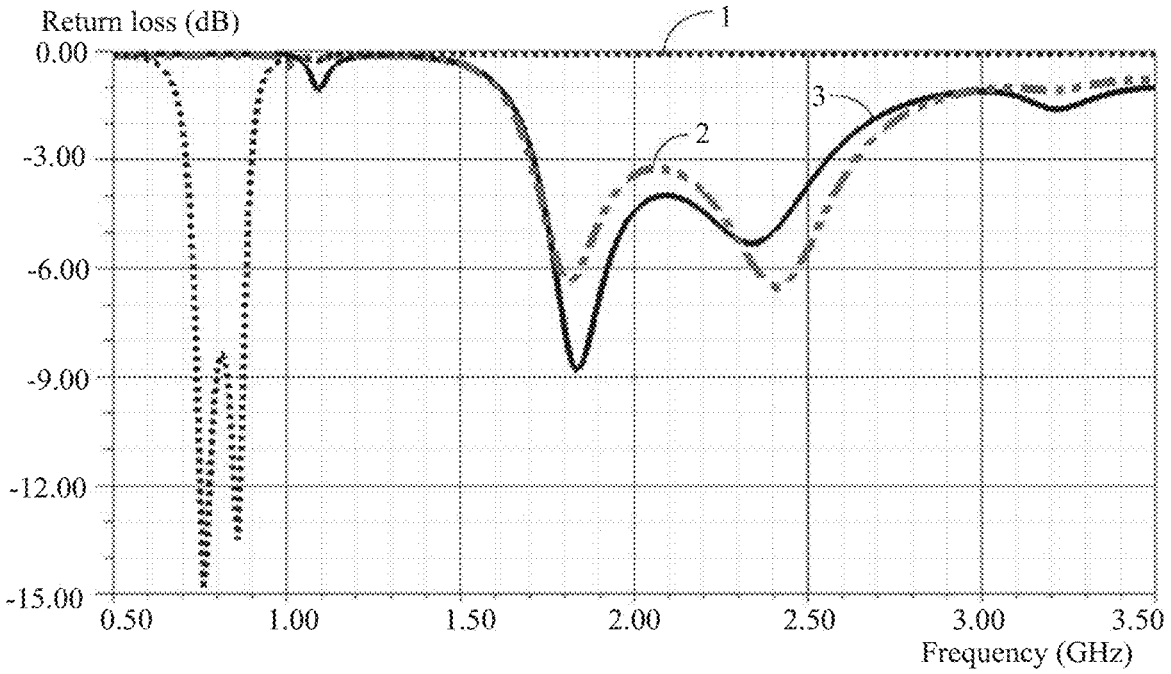
FIG. 13 is a schematic diagram 3 of return loss of a novel antenna structure according to an embodiment of the present invention.

In this way, the third feeding source may feed a radio frequency signal having a relatively low frequency into the third slot 24*c*, so that the third slot 24*c* is excited to implement a function of a low-frequency antenna. For example, a low-frequency antenna uses an operating principle of an IFA (Invert F Antenna, inverted-F antenna). FIG. 13 shows a simulation result of return loss using the novel antenna structure shown in FIG. 12, where a curve 1 is return loss after the third slot 24*c* is excited, a curve 2 is return loss after the first slot 24*a* is excited, and a curve 3 is return loss after the second slot 24*b* is excited. It can be learned that, in a low frequency band of 0.75 GHz to 0.85 GHz, a resonance occurs after the third slot 24*c* is excited. In a medium frequency band of approximately 1.8 GHz, a resonance occurs after the first slot 24*a* or the second slot 24*b* is excited, to implement an operating mode of a side feed slot antenna. In a high frequency band of approximately 2.4 GHz, a resonance occurs after the first slot 24*a* or the second slot 24*b* is excited, to implement an operating mode of a loop antenna. In this way, the terminal supports implementing a wireless communication function in three bands simultaneously, namely, low, medium, and high frequency bands.

Alternatively, based on the novel antenna structure shown in FIG. 11, as shown in 14, a fourth slot 24*d* is further disposed in the direction from the first side edge 23*a* to the center of the conductive substrate, and a fourth feeding source (not shown) corresponding to the fourth slot 24*d* is further disposed on the printed circuit board 201; and a fifth slot 24*e* is further disposed in the direction from the second side edge 23*b* to the center of the conductive substrate, and a fifth feeding source (not shown) corresponding to the fifth slot 24*e* is further disposed on the printed circuit board 201, where the fourth slot 24*d* and the fifth slot 24*e* are located on the side, distant from the display area of the terminal, of the first slot 24*a*.

Figure 14:
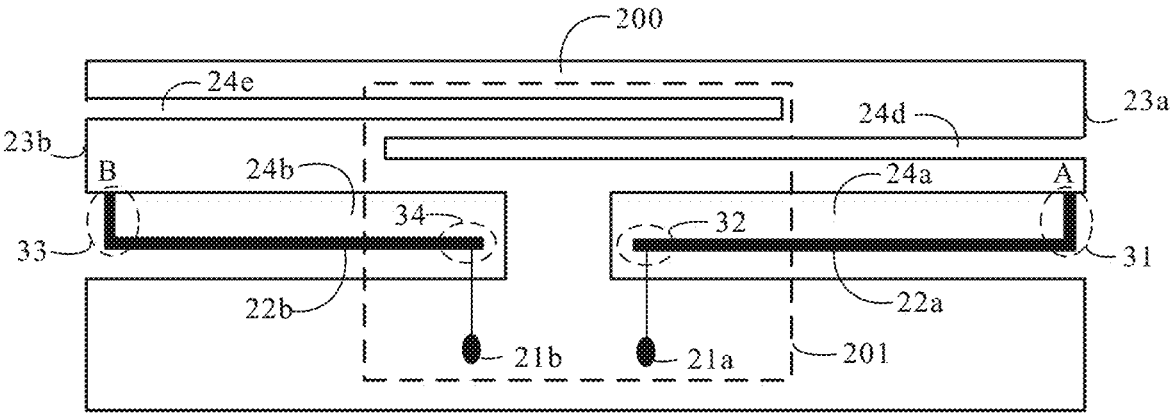
FIG. 14 is a schematic structural diagram 5 of a novel antenna structure according to an embodiment of the present invention.

An operating principle of a low frequency antenna implemented by the fourth slot 24*d* and the fifth slot 24*e* is the same as an operating principle of a low frequency antenna implemented by the third slot 24*c* in FIG. 12. A difference is that in the novel antenna structure shown in FIG. 14, the operating principle of the low frequency antenna is implemented on two sides, namely, the first side edge 23*a* and the second side edge 23*b* separately. Therefore, in addition to being operable simultaneously in the three bands, namely, low, medium, and high frequency bands, the novel antenna structure may further switch between antennas on any two side edges. For example, when a user holds the terminal from the right side (the first side edge 23*a*), the user may choose to use the novel antenna structure on the left side (the second side edge 23*b*) to perform wireless communication. Because the second slot 24*b* and the fourth slot 24*d* are disposed on the second side edge 23*b*, the second slot 24*b* may support operating of the terminal in the medium frequency band and the high frequency band, and the fourth slot 24*d* may support operating of the terminal in the low frequency band. Therefore, after the switching, the terminal may still operate in the three bands, namely, the low, medium, and high frequency bands.

Figure 15:
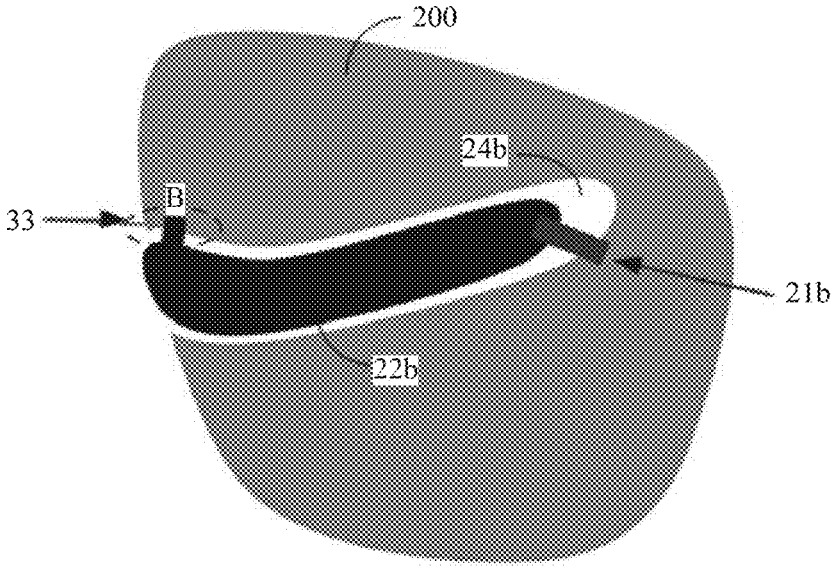
FIG. 15 is a schematic structural diagram 6 of a novel antenna structure according to an embodiment of the present invention.

In addition, the foregoing conductive substrate 200 may be specifically set to have a flat-surface shape (as shown in FIG. 4 or FIG. 9). Alternatively, as shown in FIG. 15, the conductive substrate 200 may alternatively be set to have a curved-surface shape. For example, when a side edge of the terminal is designed to have a radian, a corresponding side edge on the conductive substrate 200 may alternatively be set to be a curved-surface structure shown in FIG. 15.

Certainly, the foregoing conductive substrate 200 may be used as a metal housing of the entire terminal. In this way, using the terminal that is provided by this embodiment and that has the novel antenna structure not only can ensure radiation efficiency of the novel antenna structure, but also can take an appearance of the terminal into consideration.

For example, widths of the first slot 24*a* and the second slot 24*b* may be 3 mm, and lengths of the first slot 24*a* and the second slot 24*b* may be 300 mm. To be specific, a quarter-wavelength slot antenna (Quarter-Wavelength Slot Antenna. QWSA) is formed. Certainly, a person skilled in the art may set the width and the length of the first slot 24*a* or the second slot 24*b* based on actual experience or actual requirements. No limitation is imposed in the embodiments of the present invention.

So far, the embodiments of the present invention provide a terminal. The terminal includes a conductive substrate and a printed circuit board that are disposed opposite to each other, and a first slot is disposed in a direction from a first side edge of the conductive substrate to a center of the conductive substrate, where a first feeder is disposed inside the first slot, a first connection end of the first feeder is connected to a lap joint of the first side edge, a second connection end of the first feeder is connected to a first feeding source on the printed circuit board, and projections of the lap joint of the first side edge and the first feeding source on the conductive substrate are located on two sides of the first slot. In this way, because the first feeder is connected to the conductive substrate at a position of the first side edge, a radio frequency signal input by the first feeding source may be guided through the first feeder to a slot of the first side edge, to implement a radiation principle of a conventional side feed slot antenna. In this case, the first feeding source connected to the second connection end of the first feeder is disposed in an area close to the center of the conductive substrate, and the area can usually be covered by the printed circuit board. Therefore, the first feeding source on the printed circuit board can successfully transmit the radio frequency signal to the first feeder, thereby breaking a limitation that in a conventional side feed slot antenna, a feeding source needs to be disposed on a side edge of a conductive substrate, so that the side feed slot antenna can really be used in the terminal.

It may be clearly understood by a person skilled in the art that, for the purpose of convenient and brief description, division of the foregoing function modules is taken as an example for illustration. In actual application, the foregoing functions can be allocated to different function modules and implemented according to a requirement, that is, an inner structure of an apparatus is divided into different function modules to implement all or part of the functions described above. For a detailed working process of the foregoing system, apparatus, and unit, reference may be made to a corresponding process in the foregoing method embodiments, and details are not described herein.

In the several embodiments provided in this application, it should be understood that the disclosed system, apparatus, and method may be implemented in other manners. For example, the described apparatus embodiment is only an example. For example, the module or unit division is only logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electrical, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present invention essentially, or the part contributing to the prior art, or all or a part of the technical solutions may be implemented in the form of a software product. The software product is stored in a storage medium and includes several instructions for instructing a computer device (which may be a personal computer, a server, or a network device) or a processor (processor) to perform all or a part of the steps of the methods described in the embodiments of the present invention. The foregoing storage medium includes: any medium that can store program code, such as a USB flash drive, a removable hard disk, a read-only memory (ROM, Read-Only Memory), a random access memory (RAM, Random Access Memory), a magnetic disk, or an optical disc.

The descriptions are only specific implementations of the present invention, but are not intended to limit the protection scope of the present invention. Any variation or replacement readily figured out by persons skilled in the art within the technical scope disclosed in the present invention shall fall within the protection scope of the present invention. Therefore, the protection scope of the present invention shall be subject to the protection scope of the claims.

What is claimed is:

1. A terminal, comprising:

a printed circuit board;

a conductive substrate disposed opposite to and separate from the printed circuit board, wherein the conductive substrate comprises a first slot disposed as an opening within the conductive substrate in a direction from a first side edge of the conductive substrate to a center of the conductive substrate, and wherein a projection of the printed circuit board on the conductive substrate is located inside the conductive substrate; and a first feeder disposed inside the first slot in the opening within the conductive substrate, wherein a first connection end of the first feeder is coupled to a lap joint of the first side edge, wherein a second connection end of the first feeder is coupled to a first feeding source on the printed circuit board, and wherein projections of the lap joint of the first side edge and the first feeding source on the conductive substrate are located on two sides of the first slot.

2. The terminal of claim 1, wherein the first feeding source is located on a side proximate to a display area of the terminal, and wherein the lap joint of the first side edge is located on a side of the first slot distant from the display area of the terminal.

3. The terminal of claim 2, wherein a third slot parallel to the first slot is disposed on the conductive substrate, wherein a slotted position of the third slot is located on the side of the first slot distant from the display area of the terminal, and wherein a third feeding source corresponding to the third slot is disposed on the printed circuit board.

4. The terminal of claim 2, wherein a fourth slot is disposed in the direction from the first side edge to the center of the conductive substrate, wherein a fourth feeding source corresponding to the fourth slot is disposed on the printed circuit board, wherein a fifth slot is disposed in a direction from a second side edge to the center of the conductive substrate, wherein a fifth feeding source corresponding to the fifth slot is disposed on the printed circuit board, and wherein the fourth slot and the fifth slot are located on the side of the first slot distant from the display area of the terminal.

5. The terminal of claim 1, wherein a matching network is disposed on the printed circuit board, and wherein the second connection end of the first feeder is coupled to the first feeding source through the matching network.

6. The terminal of claim 5, wherein the matching network comprises a resonant circuit, wherein an antenna operating band of the terminal is a first operating band when a resonant parameter in the resonant circuit is a first parameter, wherein the antenna operating band of the terminal is a second operating band when the resonant parameter in the resonant circuit is a second parameter, wherein the first parameter is different from the second parameter, and wherein the first operating band is different from the second operating band.

7. The terminal of claim 1, wherein a second slot is disposed as a second opening within the conductive substrate in a direction from a second side edge of the conductive substrate to the center of the conductive substrate, wherein a second feeder is disposed inside the second slot in the second opening within the conductive substrate, wherein a third connection end of the second feeder is coupled to a second lap joint of the second side edge, wherein a fourth connection end of the second feeder is coupled to a second feeding source on the printed circuit board, and wherein projections of the lap joint of the second side edge and the second feeding source on the conductive substrate are located on two sides of the second slot.

8. The terminal of claim 7, wherein the first side edge and the second side edge are a group of opposite edges.

9. The terminal of claim 1, wherein the conductive substrate is in a curved-surface shape.

10. The terminal of claim 9, wherein a side edge of the terminal is configured to have a radian.

11. The terminal of claim 1, wherein the conductive substrate is a metal housing of the terminal.

12. The terminal of claim 1, wherein the first side edge is an edge that contacts a palm of a user when the terminal is used as a handheld device.

13. The terminal of claim 1, wherein the first side edge is a long edge of the terminal.

14. The terminal of claim 1, wherein the projection of the printed circuit board on the conductive substrate does not extend to the first side edge.

15. The terminal of claim 1, wherein a current on the conductive substrate is distributed along the first slot.

16. The terminal of claim 1, wherein the feeding source is coupled to the first feeder in the slot of the conductive substrate through a protruding dome in contact with the feeder.

17. The terminal of claim 1, wherein the conductive substrate is not in contact with the printed circuit board except though the first feeder.

18. The terminal of claim 1, wherein the conductive substrate is in contact with the first feeder only through the lap joint.

19. The terminal of claim 1, wherein the terminal is a smartphone.

20. The terminal of claim 1, wherein the terminal is a mobile device.

* * * * *